US009708164B2

(12) United States Patent
Jakob et al.

(10) Patent No.: US 9,708,164 B2
(45) Date of Patent: Jul. 18, 2017

(54) TRACTION SYSTEM USING A MULTI-TENDON CABLE WITH A DEFLECTION ANGLE

(71) Applicant: Soletanche Freyssinet, Rueil Malmaison (FR)

(72) Inventors: Ueli Jakob, Busswil (CH); Markus Abbuhl, Overwil (CH); Beat Joss, Hettiswil (CH)

(73) Assignee: Soletanche Freyssinet, Rueil Malmaison (FR)

( * ) Notice: Subject to any disclaimer, the term of this patent is extended or adjusted under 35 U.S.C. 154(b) by 134 days.

(21) Appl. No.: 14/016,794

(22) Filed: Sep. 3, 2013

(65) Prior Publication Data

US 2014/0061557 A1 Mar. 6, 2014

(30) Foreign Application Priority Data

Sep. 3, 2012 (EP) ..... 12306050

(51) Int. Cl.
*B66C 13/00* (2006.01)
*B66C 11/12* (2006.01)
*B66D 3/26* (2006.01)

(52) U.S. Cl.
CPC ..... *B66C 13/00* (2013.01); *B66C 11/12* (2013.01); *B66D 3/26* (2013.01)

(58) Field of Classification Search
CPC ..... E01D 19/14; B66C 13/00; B66C 11/12; B66D 3/26
USPC ..... 254/264
See application file for complete search history.

(56) References Cited

U.S. PATENT DOCUMENTS

| | | | | | |
|---|---|---|---|---|---|
| 1,453,426 | A | * | 5/1923 | Williams | 114/101 |
| 2,762,606 | A | * | 9/1956 | Morse | 254/393 |
| 2,926,001 | A | * | 2/1960 | Mack et al. | 74/469 |
| 3,279,762 | A | * | 10/1966 | Bruns | 254/266 |
| 3,401,859 | A | * | 9/1968 | Rienks et al. | 242/615.3 |
| 3,707,275 | A | * | 12/1972 | Arnold | 242/157 R |
| 3,720,291 | A | * | 3/1973 | Ivanov | 87/266 |
| 3,794,233 | A | * | 2/1974 | Dykmans | 226/183 |
| 3,901,479 | A | * | 8/1975 | Arnold | 242/157 R |

(Continued)

FOREIGN PATENT DOCUMENTS

| | | |
|---|---|---|
| WO | 2011076287 A1 | 6/2011 |
| WO | 2011116834 A1 | 9/2011 |

*Primary Examiner* — Emmanuel M Marcelo
*Assistant Examiner* — Michael Gallion
(74) *Attorney, Agent, or Firm* — Dentons US LLP

(57) ABSTRACT

The traction system comprises a plurality of substantially parallel tendons (2) movable for pulling a load, the tendons being disposed according to a pattern in a plane perpendicular to the tendons; and at least one deviator (3) for guiding the tendons, the deviator accommodating an angular deflection of the plurality of tendons. The deviator includes a support structure (4) and a plurality of segments (5) each having an inner surface facing a convex surface of the support structure, front and rear surfaces and a plurality of channels extending from the front surface to the rear surface. The channels are disposed according to said pattern in the front and rear surfaces of each segment, each tendon being received in a respective one of the channels. At least some of the segments (5) have their inner surfaces bearing on the convex surface of the support structure (4) in response to tensile forces applied to the tendons.

6 Claims, 5 Drawing Sheets

(56) References Cited

U.S. PATENT DOCUMENTS

| | | | | | |
|---|---|---|---|---|---|
| 4,013,142 | A * | 3/1977 | Hagg | 187/254 |
| 4,030,569 | A * | 6/1977 | Berkovitz | 187/254 |
| 4,068,705 | A * | 1/1978 | Cofer et al. | 164/417 |
| 4,205,871 | A * | 6/1980 | Manabe et al. | 254/333 |
| 4,480,818 | A * | 11/1984 | Frank | 254/411 |
| 4,505,081 | A * | 3/1985 | Dinis et al. | 52/223.14 |
| 4,620,615 | A * | 11/1986 | Morris et al. | 187/264 |
| 4,628,759 | A * | 12/1986 | Kobayashi et al. | 74/501.5 R |
| 4,740,109 | A * | 4/1988 | Horton | 405/224.2 |
| 4,848,052 | A * | 7/1989 | Nutzel | 52/223.13 |
| 4,893,786 | A * | 1/1990 | Huber | 254/414 |
| 5,044,222 | A * | 9/1991 | Tanaka et al. | 74/500.5 |
| 5,186,283 | A * | 2/1993 | Salmon | 187/254 |
| 5,197,157 | A * | 3/1993 | De La Fuente | 14/18 |
| 5,573,852 | A * | 11/1996 | Thal | 428/378 |
| 5,921,352 | A * | 7/1999 | Garrido et al. | 187/264 |
| 6,007,275 | A | 12/1999 | Borseth | |
| 6,292,967 | B1 * | 9/2001 | Tabatabai et al. | 14/22 |
| 6,327,825 | B1 * | 12/2001 | Sanders et al. | 52/167.1 |
| 6,354,596 | B1 * | 3/2002 | Rodriguez | 277/317 |
| 6,364,062 | B1 * | 4/2002 | Ericson et al. | 187/264 |
| 6,370,753 | B1 * | 4/2002 | Washburn | 29/407.01 |
| 6,386,516 | B1 * | 5/2002 | Lenders | 254/393 |
| 6,457,576 | B1 * | 10/2002 | Gunther et al. | 198/711 |
| 6,536,743 | B2 * | 3/2003 | Selcer et al. | 254/333 |
| 6,588,730 | B2 * | 7/2003 | Hughes | 254/134.3 R |
| 6,634,147 | B2 * | 10/2003 | Nutzel | 52/223.1 |
| 6,880,193 | B2 * | 4/2005 | Figg et al. | 14/21 |
| 7,178,637 | B2 * | 2/2007 | Asano et al. | 187/254 |
| 7,200,886 | B2 * | 4/2007 | Nuetzel et al. | 14/22 |
| 7,527,243 | B2 * | 5/2009 | Blasek | 254/333 |
| 7,641,177 | B2 * | 1/2010 | Rawdon | 254/393 |
| 7,658,351 | B2 * | 2/2010 | Hansen | 248/74.3 |
| 7,950,093 | B2 * | 5/2011 | Brand et al. | 14/22 |
| 8,210,502 | B2 * | 7/2012 | Fogg et al. | 254/406 |
| 8,640,292 | B1 * | 2/2014 | Sorkin | 14/18 |
| 8,650,691 | B2 * | 2/2014 | Collin Delavaud et al. | 14/22 |
| 8,863,906 | B2 * | 10/2014 | Mustalahti et al. | 187/254 |
| 8,869,476 | B2 * | 10/2014 | Delavaud et al. | 52/223.13 |
| 8,931,236 | B2 * | 1/2015 | Sinclair | 52/745.21 |
| 8,959,692 | B2 * | 2/2015 | Mellier et al. | 14/22 |
| 2005/0194578 | A1 * | 9/2005 | Morris | 254/134.3 FT |
| 2009/0158535 | A1 * | 6/2009 | Adrian et al. | 14/21 |
| 2011/0108786 | A1 * | 5/2011 | Meijer | 254/278 |
| 2013/0170939 | A1 * | 7/2013 | Roodenburg et al. | 414/800 |
| 2014/0217339 | A1 * | 8/2014 | Passoni | 254/134.3 FT |
| 2015/0083983 | A1 * | 3/2015 | Yi | 254/134.3 R |

* cited by examiner

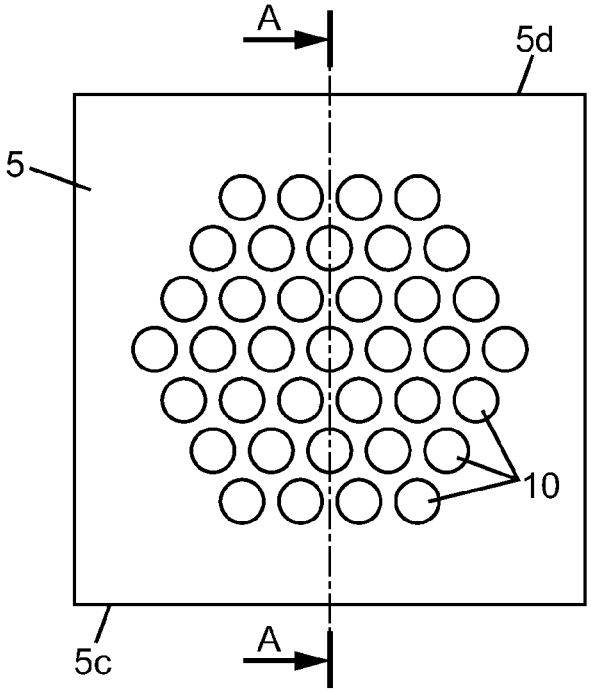
FIG. 3A
FIG. 3B
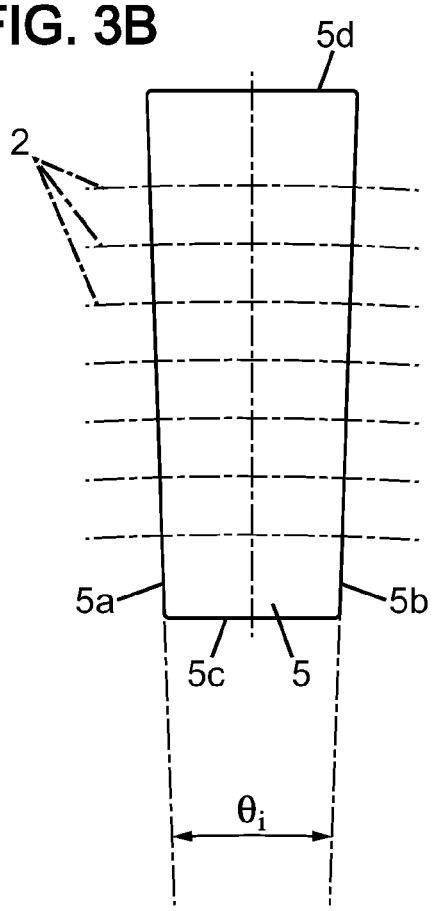
FIG. 3C
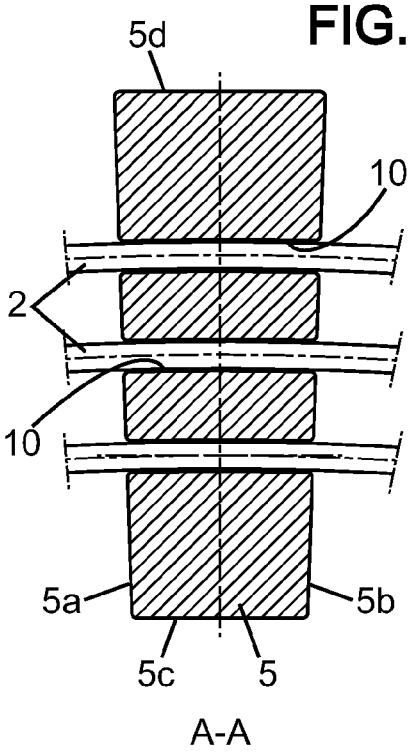

TRACTION SYSTEM USING A MULTI-TENDON CABLE WITH A DEFLECTION ANGLE

This application claims priority to European Application No. 12306050.1, filed Sep. 3, 2012, which is incorporated by reference in its entirety herein.

BACKGROUND OF THE INVENTION

The present invention relates to the field of heavy lifting and handling, and more particularly to a traction system using a cable including a plurality of substantially parallel tendons movable for pulling a load.

In certain configurations, it may be necessary to arrange for some angular deflection of the traction cable, for example for pulling over an obstacle and/or to provide sufficient leverage to carry out the lifting or tensioning operation. Depending on the configuration, the deflection angle of the cable may be constant, or may vary while the load is moving.

When the traction cable is made of parallel tendons, e.g. strands, their arrangement in the cross-section of the cable must be controlled to avoid undesired transverse contact stresses between the tendons which hinder transfer of the traction forces to the load and may damage the tendons.

It is also desirable to balance the tensile forces between the multiple tendons. Otherwise one or some the tendons take up most of the efforts, which is detrimental to the cable capacity and durability.

A deflection angle of the multi-tendon traction cable is problematic to meet these requirements. Where the cable is deflected, some of the tendons typically have a larger radius of curvature and these tendons tend to undergo larger tensile forces and to be pressed against the other tendons on the inner side of the curvature.

Some deflections systems use pulleys to reduce friction efforts. Such a solution may be difficult to implement where the tendons of the cable are arranged in multiple layers. It is incompatible with certain pulling operations, especially when very high traction forces must be applied, for example where a very heavy load (e.g. a ship or a construction work) must be lifted, lowered or dragged, where a structural prestressing or load-bearing cable must be tensioned, etc. Such very high traction forces would require extremely sturdy pulleys and excessive friction and stress would be generated at their axles and bearings.

An object of the present invention is to provide another solution which is better suited, in particular to pulling operations with very high traction forces applied to multi-tendon cables.

SUMMARY OF THE INVENTION

In accordance with the present invention, a traction system comprises a plurality of substantially parallel tendons movable for pulling a load and at least one deviator for guiding the tendons so as to provide an angular deflection of the plurality of tendons. The tendons are spaced apart to be arranged according to a pattern in a plane perpendicular to the tendons. The deviator includes a support structure and a plurality of segments each having an inner surface facing a convex surface of the support structure, front and rear surfaces and a plurality of channels extending from the front surface to the rear surface. The channels are disposed according to the aforesaid pattern in the front and rear surfaces of each segment, each tendon being received in a respective one of the channels. At least some of the segments have their inner surfaces bearing on the convex surface of the support structure in response to tensile forces applied to the tendons.

Significant deflection angles, from 0° up to 180°, can be realized. The overall deflection angle can vary over time if the pulling configuration requires. Movement of the tendons and the load can take place in both directions, e.g. for lifting and lowering the load. The group of tendons is guided according to their set geometric pattern. The tendons are thus protected from damage.

In an embodiment, the segments having inner surfaces bearing on the convex surface of the support structure form a series of n mutually abutting segments along the tendons, where n is a number greater than 1, and for $1<i\leq n$, the $i^{th}$ segment of the series has its front surface in abutment with the rear surface of the $(i-1)^{th}$ segment of the series. Each segment of the deviator accommodating an increment $\theta_i$ of angular deflection of the tendons where i=1, 2, . . . , N is an index for the N segments of the deviator, the above-mentioned series typically has a number $n\leq N$ of segments such that the angular deflection θ provided by the deviator is between $$\sum_{i=1}^{n}\theta_i$$

and $$\sum_{i=1}^{n+1}\theta_i.$$

Embodiments further include one or more of the following features:

- the deviator further comprises at least one abutment arranged for limiting movement of the segments along the plurality of tendons;
- each segment of the deviator accommodates an increment of angular deflection in a range of 0° to 12° or more, preferably 0° to 5°;
- the shape of each channel of a segment is selected to receive a tendon bent by a predetermined increment of angular deflection, with a clearance sufficient to also accept the tendon extending straight through said channel;
- the channels open to the front and rear surfaces of a segment with rounded edges;
- the channels of a segment have a substantially dihedral profile, preferably have a curved or a trumped shape.

BRIEF DESCRIPTION OF THE DRAWINGS

Further features and advantages of the invention will become apparent in the following detailed description of embodiments which are given by way of non limiting examples with reference to the appended drawings, in which:

FIG. 3A is a cross-sectional view, perpendicular to the traction cable, of an exemplary deflection segment of the deviator;

FIG. 3B is a lateral view of that deflection segment;

FIG. 3C is another cross-sectional view of the deflection segment, along plane A-A shown in FIG. 3A;

DESCRIPTION OF EMBODIMENTS

The invention is described below in its application to a lifting system without this implying any limitation to other types of application. The lifting system is applicable in various configurations, including in marine environments, for example for tilting-up a structure immerged entirely or partially in water.

The cable 1 used in a traction system for heavy lifting or tensioning works includes a plurality of parallel tendons 2 which can be tensioned for pulling a load attached to an end of the cable. Perpendicularly to the cable, the parallel tendons 2 are spaced apart from each other according to a predefined pattern such as that shown in FIG. 1A or 1B. The tendons 2 may consist of strands of metallic wires, such as corrosion-protected steel wires. For example, they consist of 7-wire high tensile strand having a 12 to 18 mm nominal diameter.

Figure 1A:
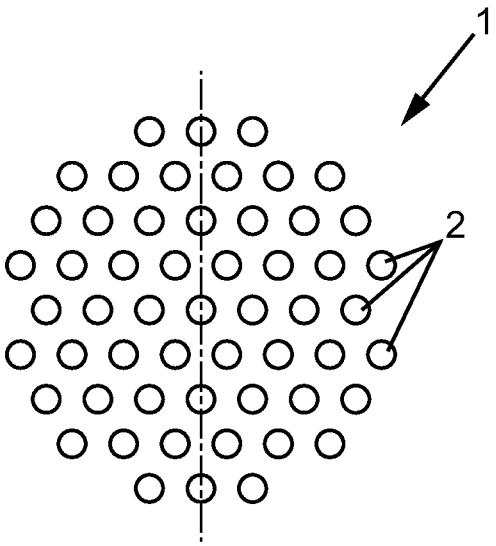
FIGS. 1A-B show examples of 2D patterns according to which a plurality of parallel spaced apart tendons may be arranged in the cross-section of a traction cable.
Figure 1B:
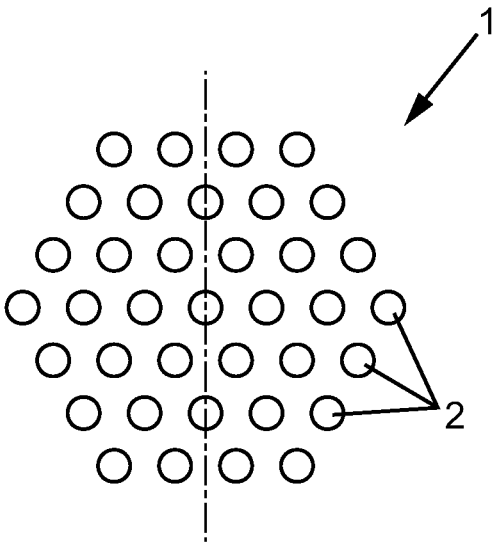

In the example of FIG. 1A, the traction cable 1 consists of 55 parallel strands 2 arranged according to a hexagonal lattice in a pattern having an overall dodecagon shape. FIG. 1B shows another cable 1 made of 37 parallel strands 2 arranged according to a hexagonal lattice in a pattern having an overall hexagon shape. In both cases, the pattern is bidimensional and made of plural layers, so a deflection angle of the traction cable may cause transverse contact forces between the tendons.

Figure 6:
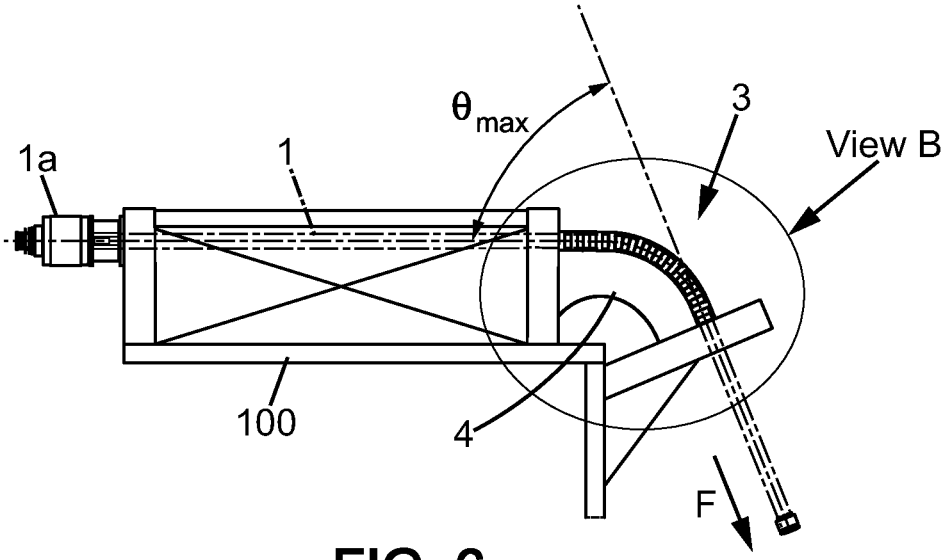
FIG. 6 illustrates an example of application of the traction system where the deflection angle of the cable varies.
Figure 7A:
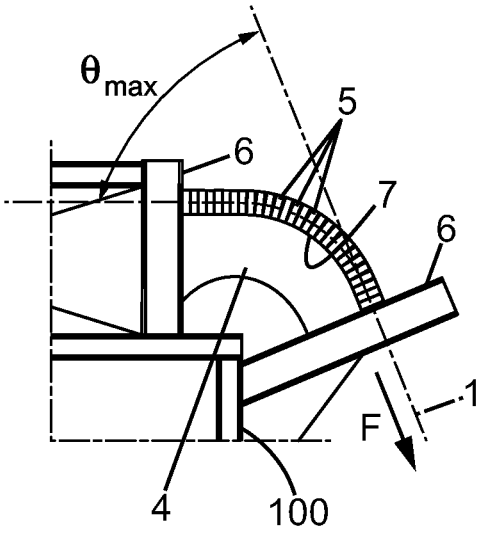
FIG. 7 A-C are an enlarged views of detail B of FIG. 6 showing the deviator at different stages with different deflection angles.
Figure 7B:
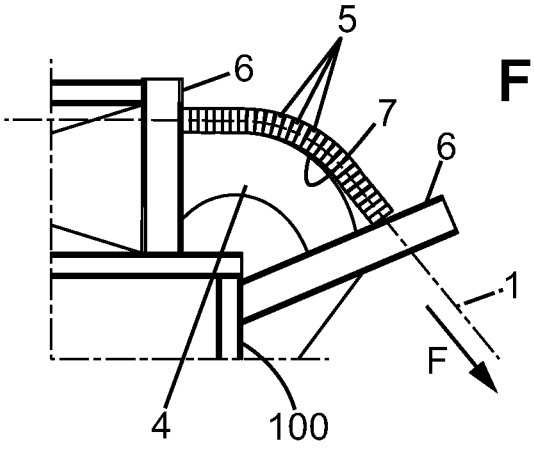
Figure 7C:
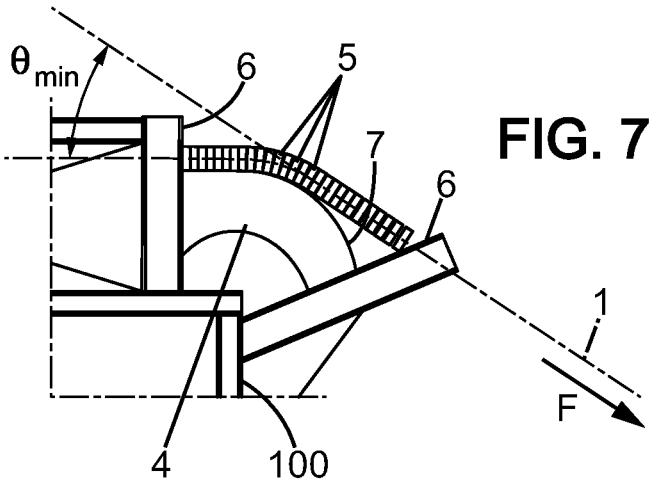

At one end of the cable 1, the tendons 2 are anchored onto a load (not shown), while at the other end, the tendons are held in a pulling system as illustrated in FIG. 6 which may, for example, consist of a multi-strand jack known in the art.

The invention addresses situations where the traction cable 1 is deflected angularly, e.g. over a barrier or an edge. If, at the point of deflection, the traction cable is simply laid on a saddle, without special provision for keeping the organization of the tendons 2 constituting the cable, the stresses to which the tendons are subjected can be classified as follows:

A. Tensile forces associated with lifting and pulling;
B. Bending moments associated with the curvature;
C. Radial contact forces and friction of the strands on the saddle;
D. Radial contact forces and friction between strands;
E. Changes of tensile forces, contact forces and friction related to collapse of the tendons towards the centre of curvature of the saddle.

The above stresses A-C are inherent to the lifting configuration. Feasibility tests and qualification of the device allow validating the maximum values of tensile and bending to the cables used. However the above stresses D-E are likely to use a significant portion of the mechanical capacity of the cable, without any control. The safety margins can then be prohibitive in terms of lifting capacity.

The traction system provided by the present invention is adapted to maintaining the organization of the initial pattern of the tendons (as defined at the anchorages at both ends) while obtaining a controllable distribution of the efforts. Thus it avoids the above-mentioned additional loads D-E.

Figure 2:
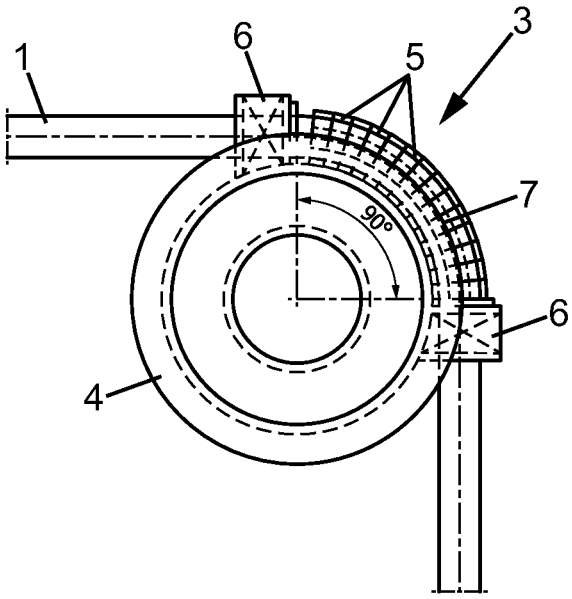
FIG. 2 illustrates a deviator according to an embodiment of the invention.

It includes a deviator 3 arranged at the point where the deflection angle is to be applied (FIG. 2). The deviator 3 comprises deflection segments 5 to guide the tendons 2 of the cable 1 around a support structure 4. The segments 5 are placed one after the other along the curved path of the cable 1 around the support structure 4. They distribute the reaction forces from the support structure 4 in a substantially uniform manner.

The support structure 4 has a convex surface 7 on which the deflection segments 5 are applied. In the example shown diagrammatically in FIG. 2, the convex surface 7 has a radius of curvature and it receives the segments 5 to guide the cable 1 so that it follows a deflection angle θ from 0° and up to 180°, for example of 90° as indicated in FIG. 2. If the lifting/pulling configuration requires, the radius of the convex surface 7 of the support structure can vary along deflection angle and/or for various operations, to accommodate the corresponding configuration of tensile and bending stresses in tendons during operation.

An embodiment of a deflection segment 5 is shown in FIGS. 3A-B. It has respective guide channels 10 for receiving the tendons 2. In the cross-section of the segment 5 perpendicular to the cable 1 (FIG. 3A), the guide channels 10 are arranged in accordance with the 2D pattern of the tendons 2 in the traction cable.

By inserting each individual tendon 2 into a respective guide channel 10, the parallel tendons remain arranged in their original pattern without distortion.

In the plane of the path followed by the cable 1 around the support structure 4 (FIGS. 2 and 3B-C), the segment 5 may have a generally trapezoidal shape between a front surface 5*a* and a rear surface 5*b* having an angle $\theta_i$ between them as shown in FIG. 3B. Assuming that a tendon 2 enters its channel 10 perpendicular to the front surface 5*a* and exits the channel 10 perpendicular to the rear surface 5*b*, it is deviated by an angle $\theta_i$ in the individual segment 5. The increment $\theta_i$ of angular deflection of the tendons accommodated by one segment is relatively small, e.g. 0° to 12° or more, preferably 0° to 5°, delimited by the front and rear surfaces 5*a*, 5*b* of the deflection segment 5 as shown in FIG. 3B. The increment $\theta_i$ of angular deflection is typically the same for all the segments 5, but it can also vary from one segment to another.

The trapezoidal shape of the segment 5 further has an inner surface 5*c* and an opposite outer surface 5*d*. The inner surface 5*c*, which is narrower than the outer surface 5*d*, is pressed against the convex surface 7 of the support structure 4 under the action of the tensile forces applied to the tendons 2.

It will be noted that the front and rear surfaces 5*a*, 5*b* of a deflection segment 5 are not necessarily flat surfaces. They may also be curved convex surfaces, or partly flat and partly curved.

The embodiment illustrated in FIG. 2 shows a simple situation in which a load needs to be pulled with a deflection angle of the cable 1, for example of θ=90°. Abutments 6 are optionally provided at both ends of the 90° curve to restrict movement of the deflection segments 5 along the cable 1. The abutments 6 may be attached to the support structure 4. It will be noted that one abutment 6 on the side of the pulling system may be enough to maintain the segments.

Together with the inserted tendons 2, the plurality of deflection segments 5 works as a chain link. During the lifting or tensioning process, there can be a fixed or a varying deflection angle θ.

In case of a varying deflection angle, the number of deflection segments 5 having their inner surfaces 5*c* bearing on the convex surface 7 of the support structure 4 is also varying for adaptation to the variation of the overall deflection angle θ.

Such a pulling configuration is illustrated in FIGS. 6 and 7A-C. In this example, the deflection angle is reduced from $\theta_{max}$ to $\theta_{min}$ as the pulling operation proceeds (for example $\theta_{max}$=50° and $\theta_{min}$=19°). The support structure 4 of the deviator 3 is attached to an edge of the load 100. An end 1*a* of the traction cable 1 is anchored to the load 100 at another place. The pulling system is installed at a fixed location to pull the cable 1 as shown by the arrow F in FIGS. 6 and 7A-C. Equivalently, the pulling system can be installed at the end 1*a* of the cable shown in FIG. 6 and a fixed anchorage can be installed at the other end. Traction of the cable 1 tilts the load 100 (FIGS. 7A-C) which causes the reduction of the deflection angle θ from $\theta_{max}$ to $\theta_{min}$ due to the overall geometry.

Initially ($\theta=\theta_{max}$, FIGS. 6 and 7A), the N segments 5 of the deviator 3 bear against the convex surface 7 of the support structure 4. Each accommodates an increment $\theta_i$ of angular deflection which adds up to $$\sum_{i=1}^{N} \theta_i = \theta_{max},$$

where the segments 5 are numbered from i=1 to i=N.

As the pulling operation proceeds (FIGS. 7B-C), some of the segments lose contact with the convex surface 7 of the support structure 4. The number n≥N of segments 5 which remain applied against the convex surface 7 is the largest integer such that $$\theta > \sum_{i=1}^{n} \theta_i.$$

In other words, $$\sum_{i=1}^{n} \theta_i \leq \theta < \sum_{i=1}^{n+1} \theta_i.$$

In the segments n+1, n+2, . . . N that left the support structure 4, the tendons 2 of the traction cable have a rectilinear trajectory. These segments are prevented from sliding too much along the cable by means of the abutments 6.

Therefore, for configurations with a variable deflection angle, the shape of the guide channels 10 in a segment 5 should be such that a tendon 2 can be deviated by the angle $\theta_i$, and can also be straight. Different possible shapes are illustrated in FIGS. 4A-C.

The channels 10 of each deflection segment 5 can be formed by a casting process when forming the deflection segment. Preferably though, the guide channels are formed by machining. In all cases, a clearance is provided in each channel of deflection segments to allow the tendon to follow either a straight path (segments detached from the support structure) or a curved path with an incremental deflection angle $\theta_i$ (segments bearing on the support structure).

Figure 4A:
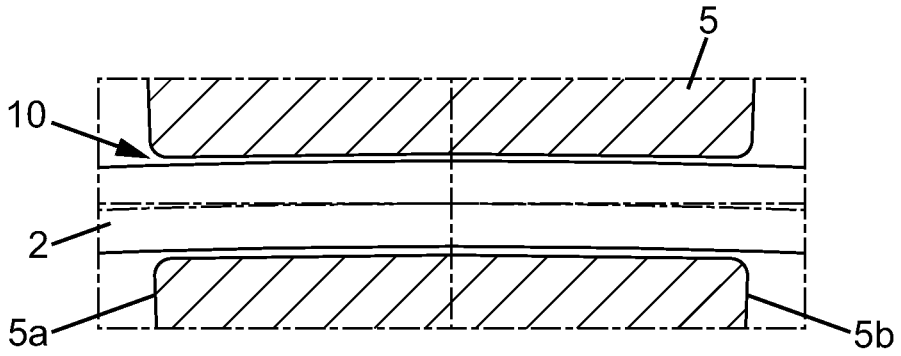
FIGS. 4A-C are sectional view of part of a deflection segment showing the shape of a guide channel according to different embodiments of the invention.

In the example of FIG. 4A, the channel 10 has a curved shape with a constant radius of curvature (depending on the radial position of the channel). The clearance between the tendon 2 and the inner wall of the channel 10 is sufficient to enable the tendon to follow a straight path through the segment 5.

Figure 4B:
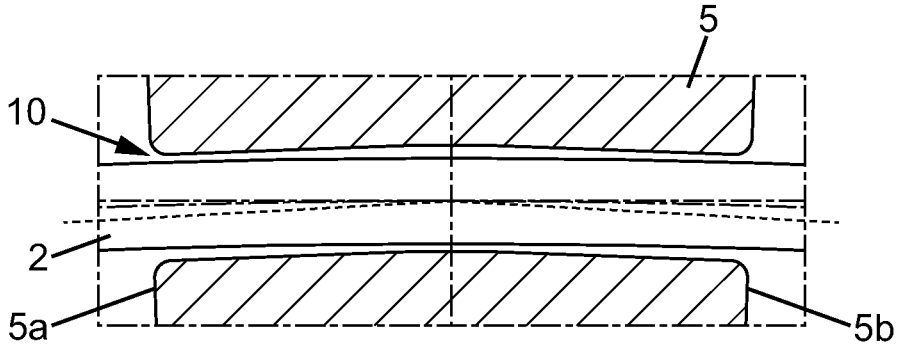
Figure 4C:
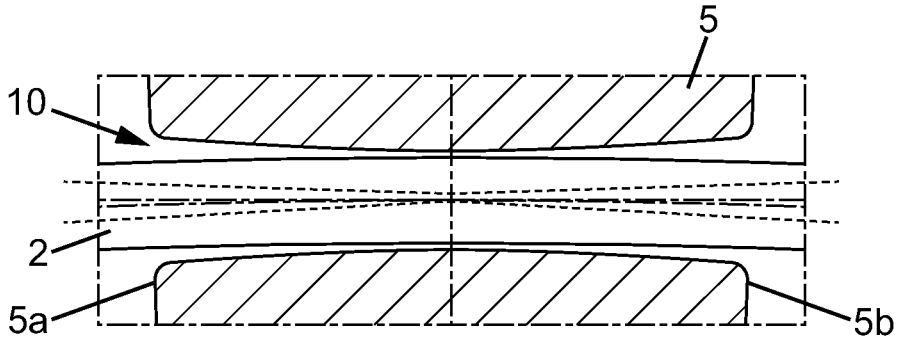

In the example of FIG. 4B, the channel 10 has a dihedral shape, with two parts each at 90°-$\theta_i$/2 with respect to the symmetry plane of the segment (radial plane of the deviator 3).

Alternatively, as shown in FIG. 4C, the channel 10 can be machined from both sides of the segment 5 using a drilling tool of varying diameter to have a trumped shape, for example, an overall trumpet shape on both sides.

In all cases, the channels 10 preferably have a tapered, e.g. rounded, shape at their ends on the front and rear surfaces 5*a*, 5*b* of the segment 5 to avoid damage to a tendon passing through the segment by a sharp edge of the channel 10.

Figure 5:
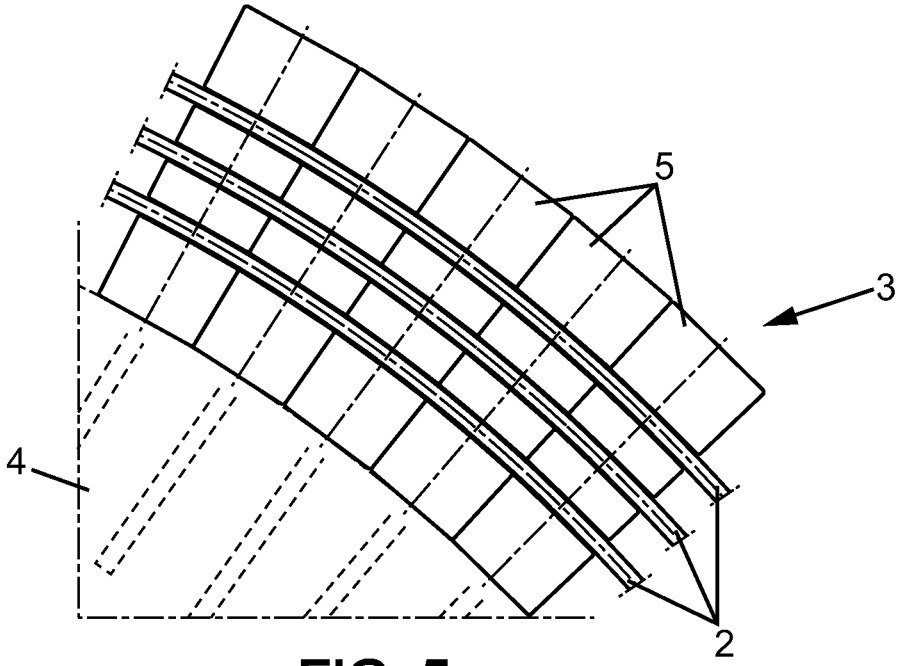
FIG. 5 is a lateral view of part of a deviator.

The deflection segments 5 of the lifting system have inner surfaces 5*a* bearing on the convex surface 7 of the support structure 4 form a series of mutually abutting segments i=1, 2, . . . , n along the tendons 2. A segment i=2, 3, . . . , n of the series has its front surface 5*a* in abutment with the rear surface 5*b* of a the preceding segment i−1 of the series. Since each deflection segment 5 is smoothly machined, the channels 10 of the series of mutually abutting segments 5 form a continuous conduit for guiding each tendon 2 inserted within the deflection segments 5, as illustrated in FIG. 5.

To reduce the friction loss occurring within the deviator, all tendons may be lubricated at least inside the guide channels 10 of the segments 5 by a lubricant, for example silicon grease.

An equal load distribution to each tendon of the traction cable can be maintained during the entire pulling process, by means of a load balancing device arranged in the pulling system.

Many modifications and variations of the above-described embodiments are made possible in light of the above teachings without departing from the invention.

What is claimed is:

1. A traction system, comprising:

a plurality of substantially parallel tendons of a cable movable for pulling a load, the tendons being spaced apart according to a pattern in a plane perpendicular to the tendons; and at least one deviator for guiding the tendons, the deviator providing an angular deflection of the plurality of tendons, wherein the deviator includes a support structure and a plurality of segments, each segment having a body comprising an inner surface facing a convex surface of the support structure, front and rear surfaces, and a plurality of channels, wherein the segments are placed one after the other along a curved path of the cable around the support structure, wherein each channel of the plurality of channels is delimited by inner walls of said body of the segment, and extends from the front surface to the rear surface of each segment, wherein the channels are disposed according to said pattern of the tendons and in the front and rear surfaces of each segment, each tendon being received in a respective one of the channels, and wherein at least some of the segments have their inner surfaces bearing on the convex surface of the support structure in response to tensile forces applied to the tendons, wherein each tendon passes through the sequence of said plurality of segments such that together with the inserted tendon, the plurality of deflection works as a chain link, wherein said segments having inner surfaces bearing on the convex surface of the support structure form a series of n mutually abutting segments along the tendons where n is a number greater than 1, and wherein for $1<i \leq n$, the $i^{th}$ segment of said series has its front surface in abutment with the rear surface of the $(i-1)^{th}$ segment of said series, and wherein each segment of the deviator accommodates an increment $\theta_i$ of angular deflection of the tendons where i=1, 2, . . . , N is an index for the N segments of the deviator, and said series has a number $n \leq N$ of segments such that the angular deflection provided by the deviator is between $$\sum_{i=1}^{n} \theta_i$$

and $$\sum_{i=1}^{n+1} \theta_i.$$

2. The traction system as claimed in claim 1, wherein the deviator further comprises at least one abutment arranged for limiting movement of the segments along the plurality of tendons.

3. The traction system as claimed in claim 1, wherein each segment of the deviator accommodates an increment of angular deflection ($\theta_i$) in a range of 0° to 12°.

4. The traction system as claimed in claim 1, wherein the shape of each channel of a segment is selected to receive a tendon bent by a predetermined increment of angular deflection ($\theta_i$), with a clearance sufficient to also accept the tendon extending straight through said channel.

5. The traction system as claimed in claim 1, wherein the channels open to the front and rear surfaces of a segment with rounded edges.

6. The traction system as claimed in claim 1, wherein the channels of a segment have a substantially dihedral profile.

* * * * *